United States Patent [19]

Anders

[11] 3,994,243

[45] Nov. 30, 1976

[54] BANK WINDOW CONSTRUCTION

[75] Inventor: Walter G. Anders, Canton, Ohio

[73] Assignee: Diebold, Incorporated, Canton, Ohio

[22] Filed: Nov. 29, 1974

[21] Appl. No.: 528,004

[52] U.S. Cl. ..... 109/2; 49/505; 52/208; 52/212; 52/476

[51] Int. Cl.[2] ..... E06B 5/00

[58] Field of Search ..... 49/505; 52/208, 212, 52/476, 498, 499; 109/2, 10

[56] References Cited

UNITED STATES PATENTS

| | | | |
|---|---|---|---|
| 1,985,909 | 1/1935 | Ziepke | 52/499 X |
| 1,995,819 | 3/1935 | Rogers | 109/10 X |
| 2,724,873 | 11/1955 | Cameron | 52/499 X |
| 3,323,262 | 6/1967 | Di Cesare et al. | 52/212 |
| 3,571,995 | 3/1971 | Kasprzak | 52/212 |

FOREIGN PATENTS OR APPLICATIONS

| | | | |
|---|---|---|---|
| 588,730 | 12/1959 | Canada | 52/212 |
| 449,218 | 4/1968 | Switzerland | 49/505 |

*Primary Examiner*—Paul R. Gilliam
*Assistant Examiner*—David H. Corbin
*Attorney, Agent, or Firm*—Frease & Bishop

[57] ABSTRACT

A modular bank window construction having a main window frame and a glass frame within the main frame in which bullet-resistant glass is mounted. Window frames of various widths are assembled with the same vertical window frame components and with horizontal window frame components cut to various lengths depending on a selected window width. Various window widths are assembled using one or a plurality of standard sized bullet-resisting glass panels. The exterior portions of the main window frame may be clad with any one of a number of different thin sheet materials such as bronze, aluminum, stainless steel, and various colors of vinyl material to satisfy architectural specifications. The cladding and primary window frame components are constructed to provide weather-sealed joints at the primary frame corners and also between the main window frame and glass frame. Both the window and glass frames are adjustable to accommodate different wall and glass thicknesses; and the window frame has adjustable means to accommodate variations in the window receiving opening formed in a building wall. The glass frame is constructed to permit a glass panel to be replaced from the building exterior, and interior access is required only for securing bolts for the glass retention means. The main window frame contains a built-in raceway for cable wiring for electrical outlets, switch controls and electrical accessories.

10 Claims, 29 Drawing Figures

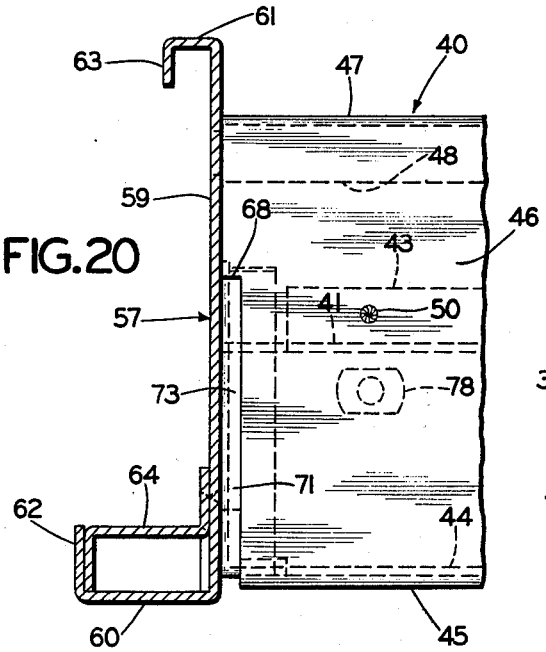
FIG.20
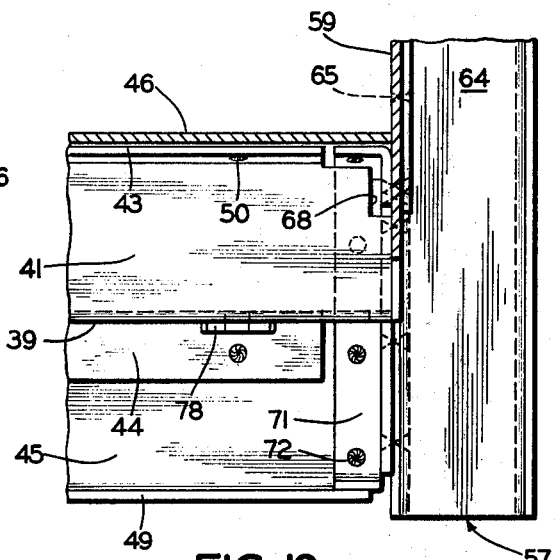
FIG. 19
FIG.17
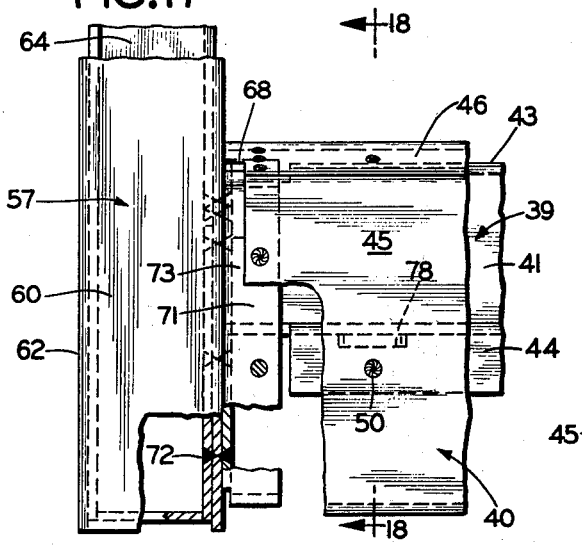
FIG.18
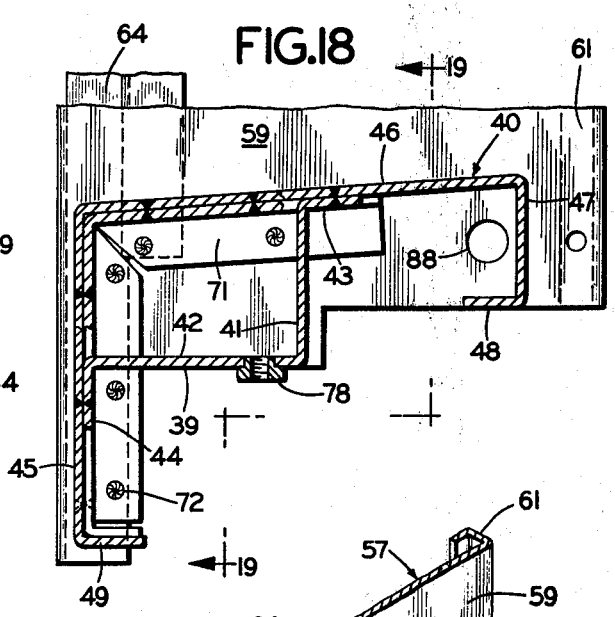
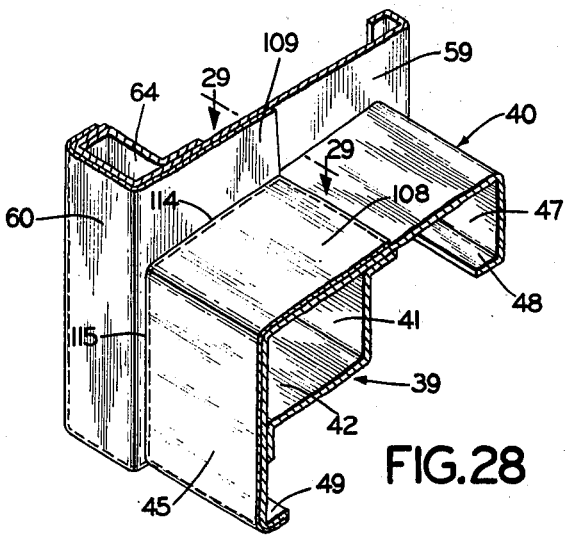
FIG.28
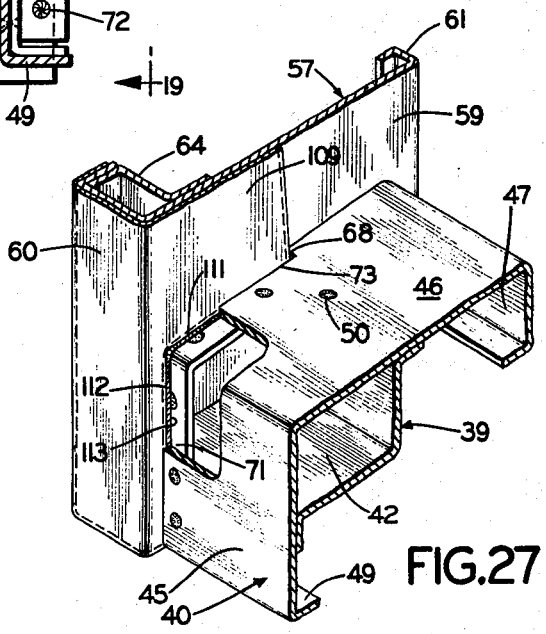
FIG.27

BANK WINDOW CONSTRUCTION

BACKGROUND OF THE INVENTION

1. Field of the Invention

The invention relates to windows for bank tellers which are installed in walls of bank buildings to protect a bank teller by the bullet-resisting glass mounted in the window frame while the teller has visual communication with a customer conducting a banking transaction at drive-up or walk-up deal drawer devices at the window, or at spaced auto-teller facilities having customer pneumatic tube terminals communicating with similar teller terminals.

2. Description of the Prior Art

Prior protective windows for bank tellers for walk-up or drive-up deal drawer units, or for spaced visual auto-teller customer stations normally have used a bay window-type of construction which essentially has been custom or tailor-made for each installation. Such prior bay window-type custom made tellers bank windows are shown, for example, in U.S. Pat. Nos. 2,722,179, 2,949,870, 3,059,840, 3,237,853, 3,302,871 and 3,429,082. While such prior bank window constructions have satisfied the objectives described in the listed patents, they nevertheless have been relatively expensive to build, install, repair and maintain because of their custon-made nature, or because of being specially designed and fabricated to meet special architectural specifications.

Heretofore, a bay window-type construction projecting from a building wall as seemed desirable to provide good teller visibility. This has involved complications in the design and construction of the window frame in which the glass is mounted; and where special architectural requirements were made as to the frame materials, the entire frames had to be formed of the specified material such as stainless steel, bronze, and the like.

Such requirements further have presented complications in providing the necessary weather seals around the frame and where the bullet-resistant glass panels are mounted in the frame. Also great difficulties have been encountered when it has been necessary to replace a bullet-resistant glass panel in prior structures.

I am not aware of any bank window structures which are modular in construction so as to accommodate various window widths, wall thickness and glass thicknesses while using and requiring only the same basic window and glass frame components for all sizes of windows, walls and glass.

There exists a need in the field of bank window structures for a window construction permitting increased visibility through increased window width, while avoiding bay window-type structure; which has primary window frame components fabricated of formed sheet steel members clad on exterior surfaces with selected or decorative thin sheet material to satisfy architectural requirements; in which bullet-resistant glass panels may be installed and replaced by access from the building exterior in the wall of which the window frame is located; and in which window frame conduits or raceways are located communicating entirely around the frame containing prewired electrical cables to accommodate switches, electrical outlets and electrical accessories on the inside of the window so as to eliminate the requirement of wiring electrical components in and adjacent the window after the installation of the window in the building wall.

SUMMARY OF THE INVENTION

Objectives of the invention include providing a new modular bank window construction having a main window frame and a glass frame within the main frame in which bullet-resistant glass is mounted, wherein vertical and horizontal frame components are used for the construction of windows of various widths, and to accommodate one or two or three glass panels of standard size; providing such bank window constructions wherein main window frame primary vertical and horizontal frame components comprise formed structural members preferably made of sheet steel having the required structural strength, and wherein the exterior surfaces of the primary components may be clad with any desired sheet material to satisfy architectural decorative appearance designs; providing such modular bank window structures which may be weather sealed readily at all primary window frame and glass frame joints; providing such bank window structures which are adjustable to accommodate various building wall thicknesses and which have adjustably means for installing the window in a building wall opening regardless of slight variations in the sizes of such openings; providing such bank window structures in which various glass thicknesses of bullet-resisting glass panels may be mounted, and in which the glass panels are installed and may be replaced from the exterior of building walls in which the windows are mounted; providing such bank window structures having built-in raceways encompassing the main window frames wherein electrical cables may be installed as prewiring at the window fabrication plant; and providing new bullet-resisting bank window constructions which achieve the stated objectives in an effective and efficient manner, which may be manufactured, installed and repaired with minimum expense as compared with prior structures, and which solve problems and satisfy needs existing in the art.

These and other objects and advantages may be obtained by the new bank window construction, the general nature of which may be stated as including in bullet-resisting glass bank window construction adapted to be mounted in an opening in a building wall; front and back window frames each having head, jamb and sill members forming a rectangular frame; each head, jamb and sill member having a terminal flange and engaging flange means spaced inwardly of the rectangular frame from the terminal flange; the engaging flange means on the front frame being telescoped into the engaging flange means back frame; bolt means accessible at the back frame engaged with the front frame operative to clamp the terminal flanges on the front and back frames against exterior and interior building wall surfaces with the front and back telescoped flange means extending through a window frame opening in a building wall; separable rectangular inner and outer glass frame means; means mounting the inner glass frame means within the front window frame engaging flange means; bullet-resisting glass panel means mounted between the inner and outer glass frame means; bolt means accessible interiorly of the window frame clamping the outer glass frame against the glass panel means and to the inner glass frame means.

BRIEF DESCRIPTION OF THE DRAWINGS

A preferred embodiment of the invention — illustrative of the best mode in which applicant has contemplated applying the principles — is set forth in the following description and shown in the drawings and is particularly and distinctly pointed out and set forth in the appended claims.

FIG. 17 is a fragmentary side view with parts broken away, of the lower left-hand corner of the window frame shown in FIGS. 1 and 5 illustrating the assembly of the primary frame;

FIG. 18 is a section taken on the line 18—18, FIG. 17;

FIG. 19 is a fragmentary sectional view taken on the line 19—19, FIG. 18;

FIG. 20 is a fragmentary sectional view taken on the line 20—20, FIG. 17;

FIG. 27 is a view similar to FIG. 16 illustrating one stage in assembling the trim cladding material;

FIG. 28 is a view similar to FIG. 27 showing a later stage applying the cladding trim.

Similar numerals refer to similar parts throughout the drawings.

DESCRIPTION OF THE PREFERRED EMBODIMENT

Figure 1:
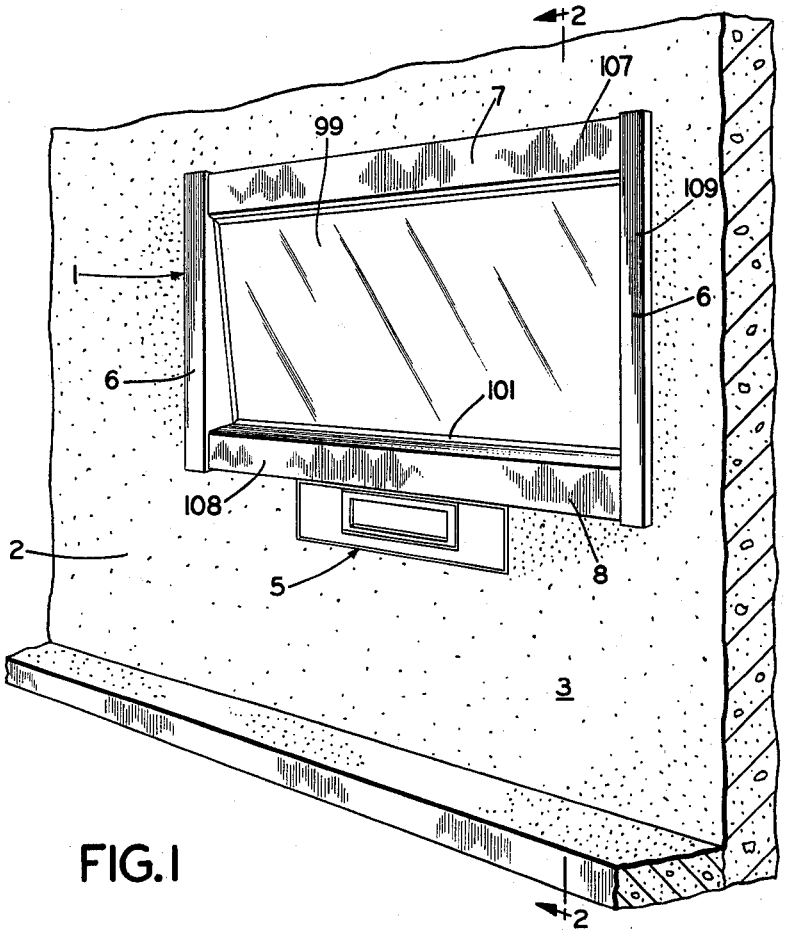
FIG. 1 is a somewhat diagrammatic perspective view, with parts broken away, of a bank building wall in which the new bank window structure is installed, having a single standard bullet-resisting glass panel, and showing a typical deal drawer installed below the window.
Figure 2:
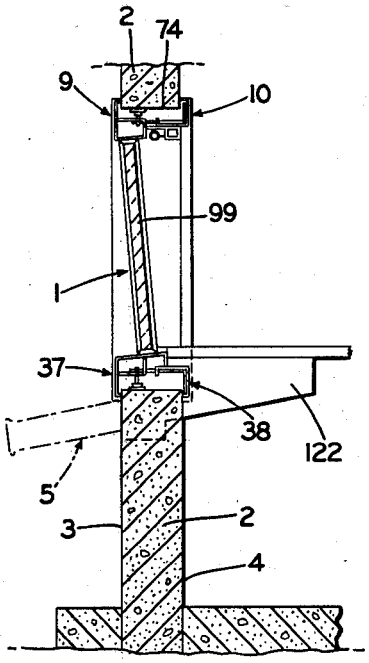
FIG. 2 is a vertical section taken on the line 2—2, FIG. 1.

A bank window incorporating the features of the invention is indicated generally at 1 in FIG. 1 installed in a building wall 2 having an outer or exterior surface 3 and an inner or interior surface 4 (FIG. 2). A deal drawer generally indicated at 5 is illustrated in FIGS. 1 and 2 below the window 1, and the deal drawer 5 may be of any one of the types shown in U.S. Pat. Nos. 2,949,870, 3,237,853 and 3,302,871.

Figure 3:
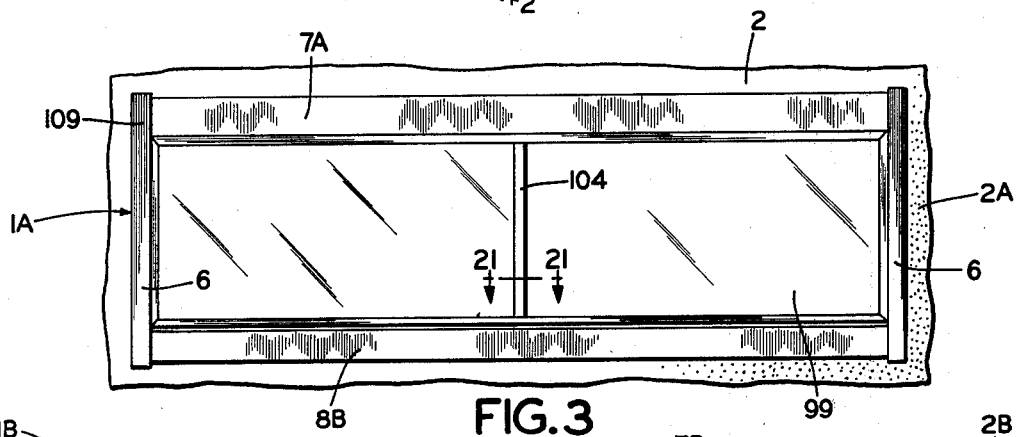
FIG. 3 is a front view of the new modular bank window structure installed in a building wall having two standard bullet-resisting glass panels.
Figure 4:
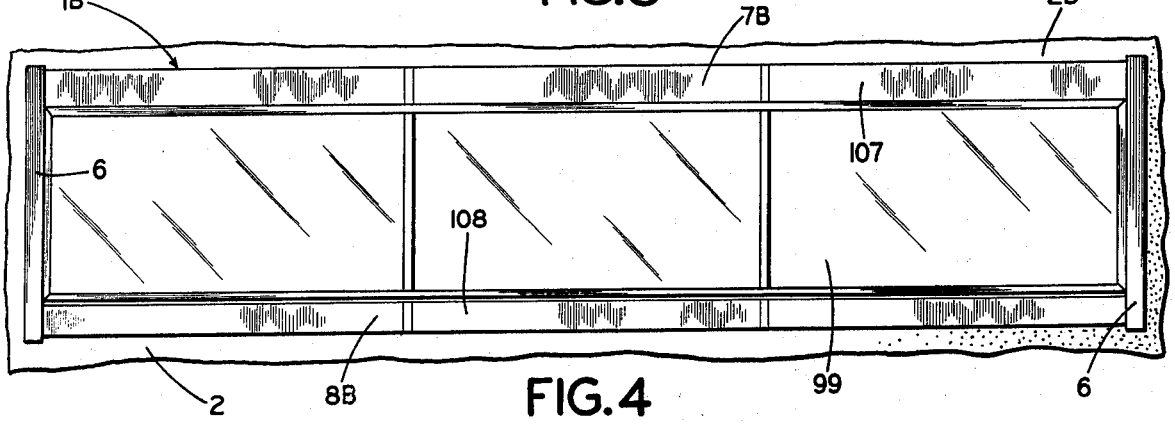
FIG. 4 is a view similar to FIG. 3 illustrating a three-glass panel window.

The new bank window construction 1A having two standard sized bullet-resistant glass panels installed in a building wall 2A is shown in FIG. 3. FIG. 4 illustrates a three-glass panel window 1B installed in a building wall 2B. The windows 1, 1A and 1B all have the modular structure characterizing the invention. The main vertical frame members 6 are the same at the ends of the windows. The upper and lower horizontal frame members 7 and 8, 7A and 8A, 7B and 8B, respectively, having the same cross-sectional form, but have different lengths to accommodate the single, double or three-panel sizes shown in FIGS. 1, 3 and 4.

It is desirable to use standard sized bullet-resisting glass panels formed of laminated bullet-resisting glass, nevertheless the new window construction is adapted for mounting glass panels of any size by changing the lengths of the upper, lower and end primary frame members. Further, glass panels of double size are available on the market having the standard height and a width twice that of the standard single glass panel. Such a double sized glass panel can be mounted in the frame illustrated in FIG. 3 instead of two single standard glass panels.

Figure 13:
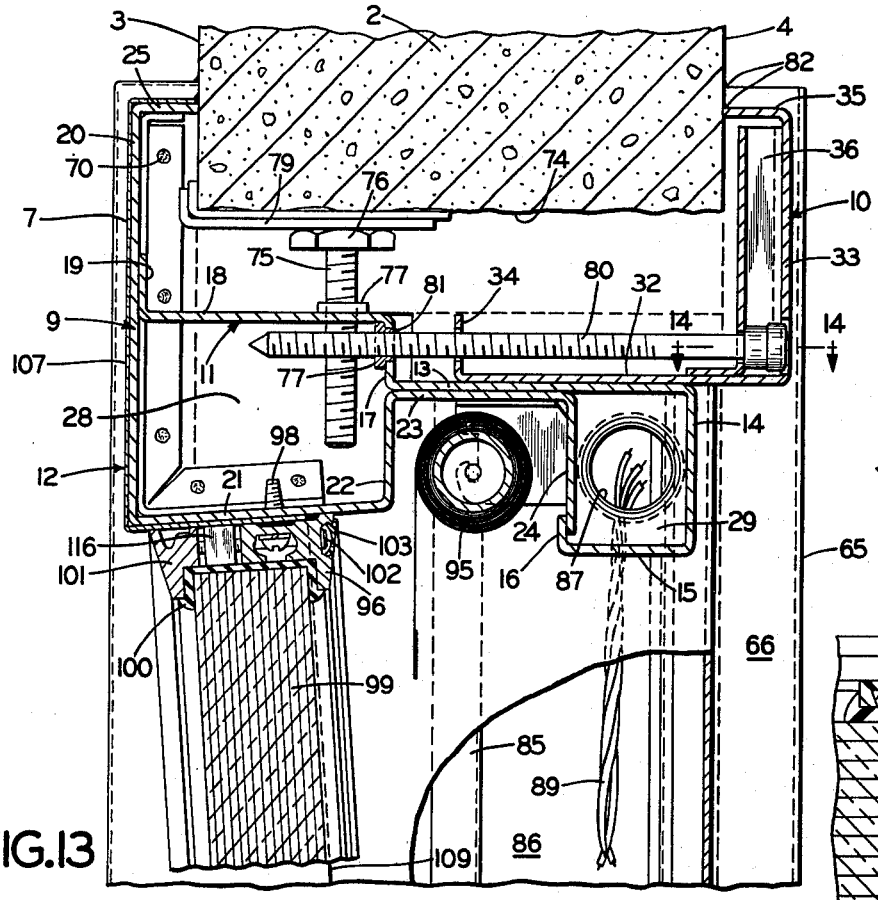
FIG. 13 is a further enlarged fragmentary section with parts broken away of the upper and lower portions of FIG. 8, particularly illustrating the raceway means built into the window frame for installing prewiring in the frame at window fabricating plant.
Figures 15, 16:
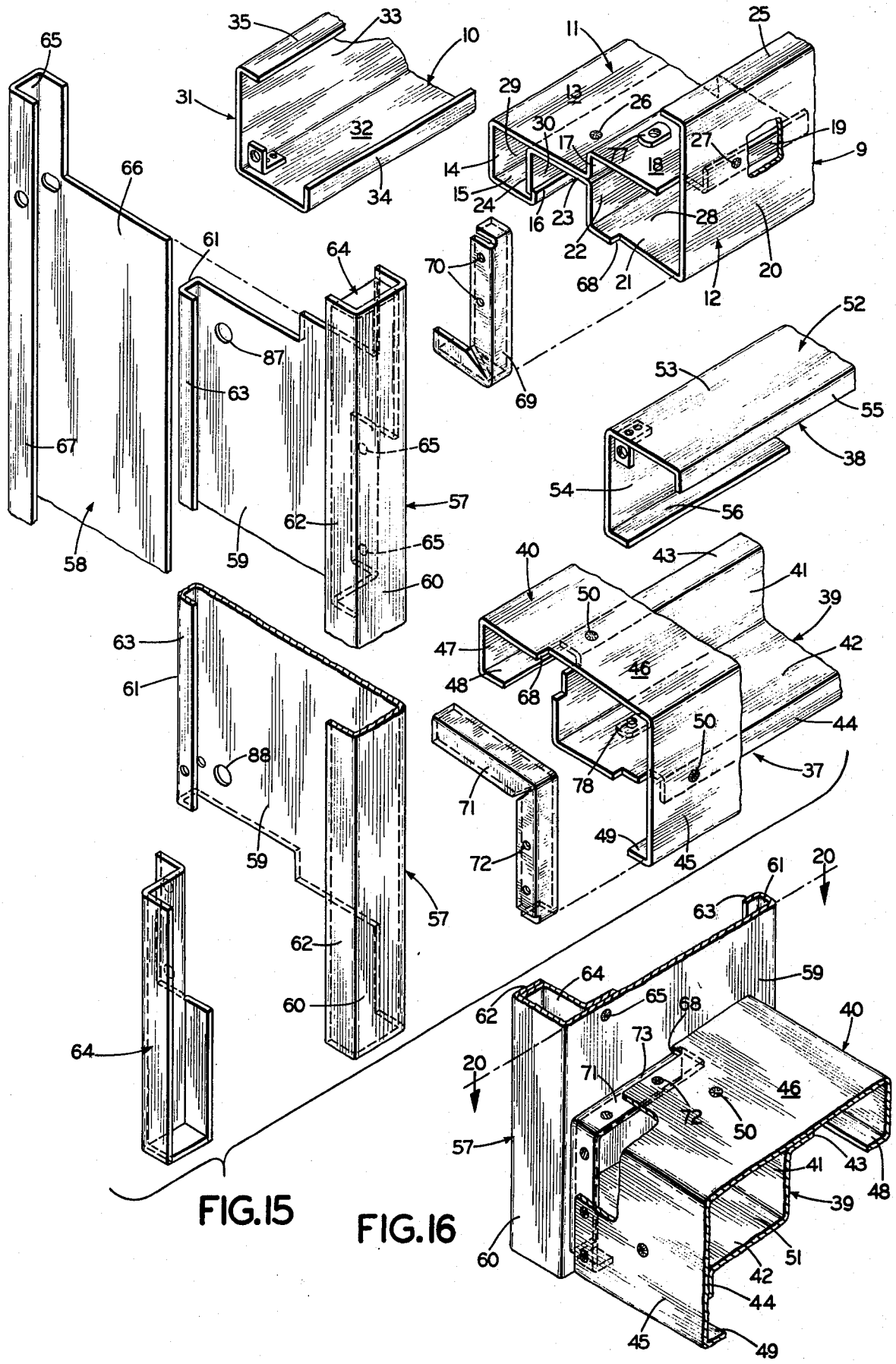
FIG. 15 is an exploded perspective view of upper, lower and side frame components which are assembled to form the upper and lower left hand corners of the window illustrated in FIGS. 1 and 5.
FIG. 16 is a fragmentary perspective view of the assembled lower left main frame corner.

The construction of the upper and lower primary frame members 7 and 8 is best shown in FIGS. 13 and 15. Each upper frame member 7 has an outer unit 9 and an inner unit 10. The outer unit 9 has two members 11 and 12, each of which is a formed sheet steel member. Member 11 is generally channel-shaped in cross section with an upper telescoping flange 13, a web 14, a lower flange 15 and an upturned terminal flange 16. The upper flange 13 is offset at 17 to be connected top rail 18 formed with an upturned terminal flange 19.

Member 12 also is channel-shaped in cross section with an outer vertical from flange 20, an outer web member 21, a medial flange 22, an inner web 23, and a downturned inner flange 24. The outer vertical flange 20 terminates at its upper end in an inturned terminal flange 25. The flange 13 and web 23 of members 11 and 12 are welded together at intervals as shown at 26. Similarly, the flanges 19 and 20 of members 11 and 12 are welded at intervals, as shown at 27. A double box cross-sectional shape thus is formed in the outer unit 9 of the upper frame member 7 (FIG. 15).

Members 20, 21, 22, 17 and 18 form an outer box-like channel 28, and members 13, 14, 15 and 24 form an inner box-like channel 29 spaced from channel 28. A rectangular recess 30 thus is located between channels 28 and 29.

Figure 14:
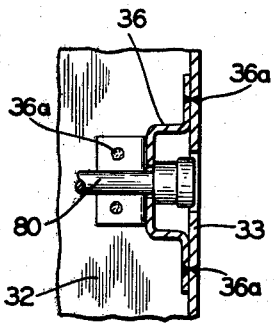
FIG. 14 is a fragmentary section looking the direction of the arrows 14—14, FIG. 13.

The inner unit 10 of the upper frame member 7 is a formed angle members 31 having a horizontal telescoping leg flange 32, a vertical leg 33, and the legs 32 and 33 have upturned and inturned terminal flanges 34 and 35, respectively (FIG. 13). A reinforcing channel bracket 36 is welded at 36*a* to each angle member leg 33 (FIG. 14) adjacent each corner of the inner unit 10 of upper frame member 7 and also at spaced intervals along the length of unit 10 (FIG. 6), for a purpose to be described.

The lower primary frame member 8 also has an outer unit 37 and an inner unit 38 (FIG. 13). The outer unit 37 has two members 39 and 40, each of which is formed as a sheet steel angle member. Member 39 has a vertical angle leg 41 and a horizontal angle leg 42 which terminate, respectively, in outturned and downturned terminal flanges 43 and 44 (FIG. 15).

Member 40 also has a vertical front flange or angle leg 45, a horizontal angle leg or web member 46 which has a downturned flange 47, and an inturned terminal telescoping flange 48, while flange 45 has an inturned terminal flange 49. The flanges 43 and 44 of member 39 are welded at intervals, as shown at 50, respectively, to the horizontal flange 46 and vertical flange 45 of member 40, thereby forming a box-like channel 51 (FIG. 16).

The inner unit 38 of the lower frame member 8 is similar to the inner unit 10 of the upper frame member 7. Unit 38 is a formed angle member 52 having a horizontal leg telescoping flange 53, a vertical leg 54, and the legs 53 and 54 have downturned and intum ed terminal flanges 55 and 56, respectively (FIG. 13). Reinforcing brackets 36, like those welded to the upper frame member inner unit 10, similarly are welded at spaced intervals along the length of unit 38, for a purpose to be described.

Each main vertical frame member 6 (FIGS. 13, 15 and 22) has an outer unit 57 and an inner unit 58. The outer unit 57 is channel-shaped in cross section with a vertical web jamb member 59, a front flange 60, a rear flange 61, and the flanges 60 and 61 terminate respectively an inturned terminal flange 62 and a terminal telescoping flange 63. A reinforcing stiffening bracket 64 (FIG. 15) is welded at 65 at the upper and lower ends of outer vertical member unit 57 between portions 59, 60 and 62, as shown in FIGS. 15 and 16.

The vertical frame member inner unit 58 (FIG. 22) is channel-shaped in cross section and has a web 65, an inner vertical telescoping flange 66 and a shorter outer terminal flange 67.

Figure 22:
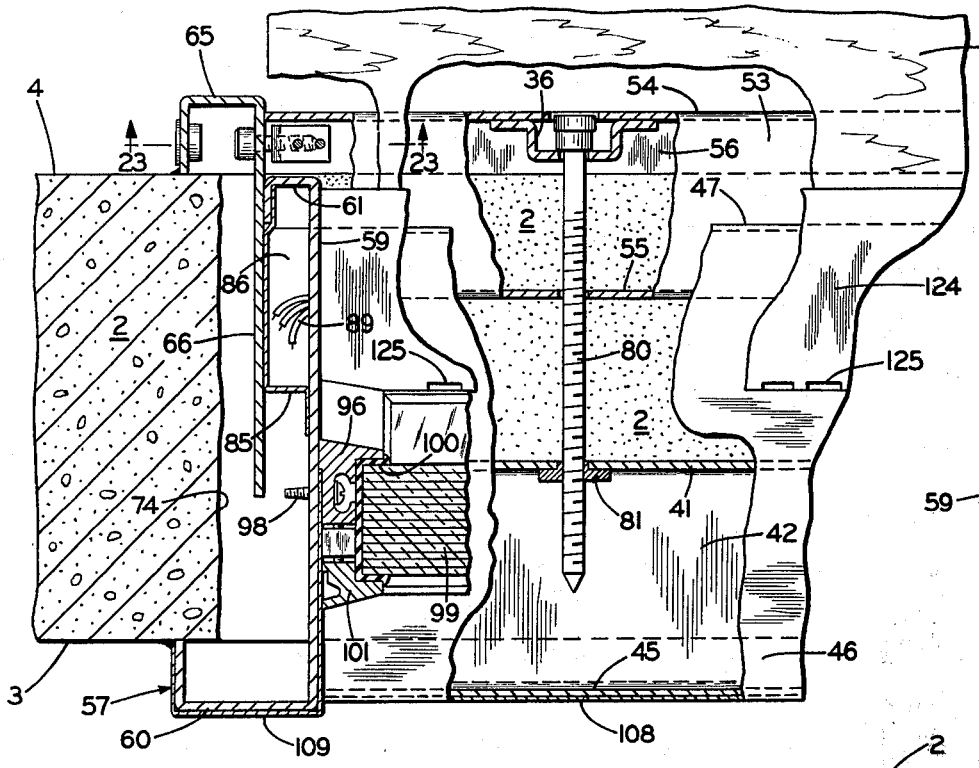
FIG. 22 is an enlarged fragmentary horizontal section, with parts broken away, looking in the direction of the arrows 22—22, FIG. 5.

Thus, the front window frame head, jamb and sill members include frame front flanges 20, 60 and 45, respectively, which extend from their respective terminal flanges 25, 62 and 49. Frame web members 21, 59 and 46 in turn extend respectively from said front flanges 20, 60 and 45 to zones within the back window frame. Further, the front frame head, jamb and sill members include, respectiively, the telescoping flanges 13, 63 and 48 which are spaceed respectively from the web members 21, 59 and 46, and are located in said zones, and are offset laterally outwardly of the frame from the web members 21, 59 and 46, as shown in FIGS. 13 and 22.

The ends of upper and lower frame member outer unit members 12 and 40 are notched at 68 along the edges of portions 20, 21, 45 and 46, as shown in FIGS. 15, 16, 17 and 20 for a purpose to be described.

An angular angle member 69 is welded within the outer box channel 28 of the upper frame member outer unit 9 (see FIGS. 13 and 15), not only to reinforce the ends of outer box channel 28 but to provide for welding at 70 to form corner connections between upper frame member 7 and the upper ends of the outer units 57 of the main vertical frame members 6.

Similarly, an angular angle member 71 is welded within the outer ends of each member 40 of lower frame member unit 37, not only to reinforce the ends of member 40 but to provide a means of welding at 72 the ends of lower frame member outer unit 37 to the lower ends of the outer units 57 of main vertical frame members 6 (FIGS. 16, 17, 19 and 20).

The angle members 69 and 71 when assembled and welded as described, form the corners of the main outer window frame between upper and lower frame members outer units 9 and 37 and the outer units 57 of vertical frame members 6. When thus assembled, recesses 73 are formed at each of the corners (FIG. 16) at the location of the notches in members 12 and 40, and the recesses extend around the outer corners where the ends of the upper and lower member outer units abut the outer units on the vertical frame members 6. These recesses 73 perform a function to be described.

Figure 5:
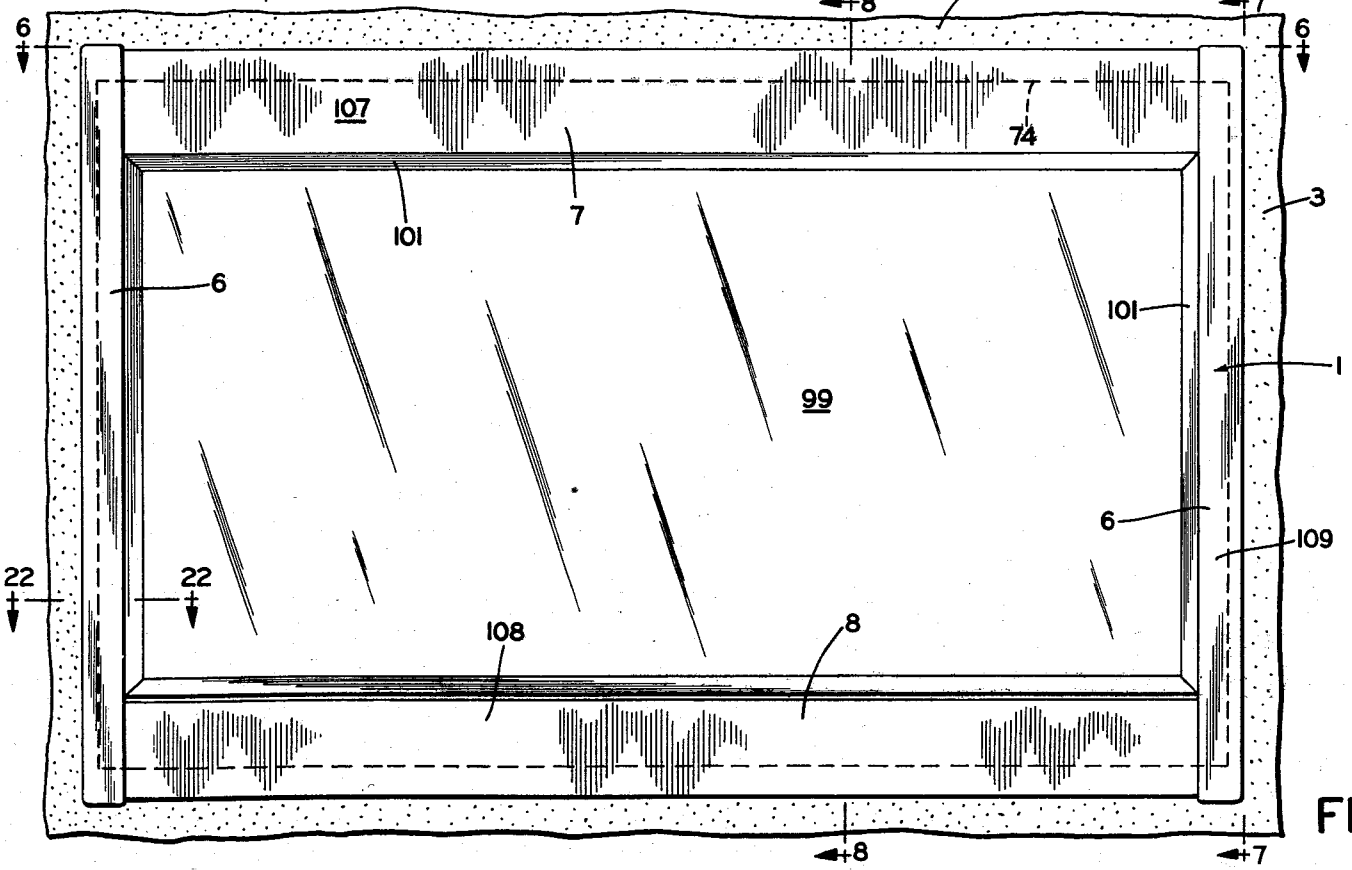
FIG. 5 is an enlarged front elevation of the window shown in FIGS. 1 and 2.

The outer frame member units 9, 37 and 57 when assembled and welded as described, form a rectangular outer frame member best shown in viewing FIGS. 1 and 5. Similarly, an inner retangular frame member is formed by connecting the ends of inner, upper and lower frame member units 10 and 38 to the inner frame member vertical units 58. This inner rectangular frame member is illustrated at the top portion of FIG. 6 and at the right-hand portion of FIG. 7. The main inner and outer rectangular frame members, as described, may be mounted within an opening 74 formed in the building wall 2.

In order to properly level the main frame in the opening 74 in the building wall, and to bring the lower frame members at the proper height, and to accommodate variations in the size of the building opening 74, a series of screw jacks 75 with bearing heads 76 are mounted in the outer units of the upper and lower frame members 7 and 8, engageable in threaded openings formed respectively at 77 and 78 in the top rail 18 of member 11 and in horizontal leg 42 of member 39 (FIGS. 13 and 15). The bearing heads 76 of screw jacks 75 engage bearing plates 79, engaging the faces of the wall opening 74.

Figure 6:
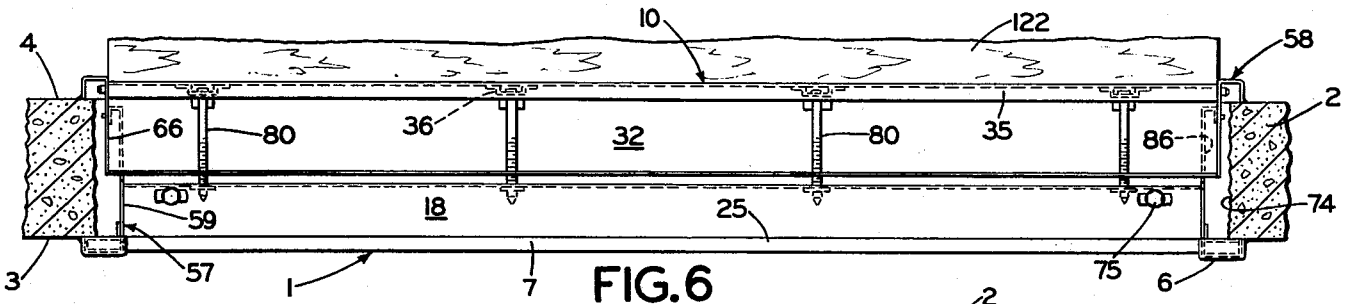
FIG. 6 is a horizontal section through the parts shown in FIG. 5, taken on the lines 6—6, FIGS. 5 and 7.

After the outer rectangular main frame member is located in proper position in the wall opening 74, the inner rectangular frame member has its telescoping flange 32, 53 and 66 telescoped, respectively, over and around the telescoping flanges 13, 48 and 63 of the outer rectangular frame. Clamping tie bolts 80 engaged in reinforcing channels 36 at intervals along the top and bottom inner frame members then are engaged in threaded openings 81 formed respectively in outer frame member upper offset portion 13 and in lower frame member leg 41 (FIGS. 6 and 13).

As the bolts 80 are drawn up, the edges of terminal flanges 25, 49 and 62 of the rectangular outer frame, and the edges of terminal flanges 35, 56 and 67 of the rectangular inner frame engage and clamp against outer and inner surfaces of the wall 2 surrounding the wall opening 74. During installation, the engagement of the terminal flanges of the inner and outer frame members may be caulked as indicated at 82 in FIG. 13.

Figure 7:
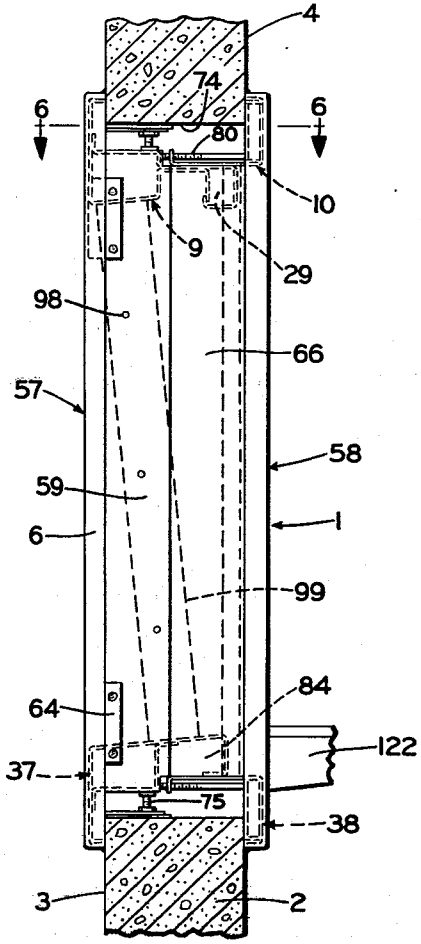
FIG. 7 is a vertical sectional view taken on the line 7—7, FIG. 5.
Figure 8:
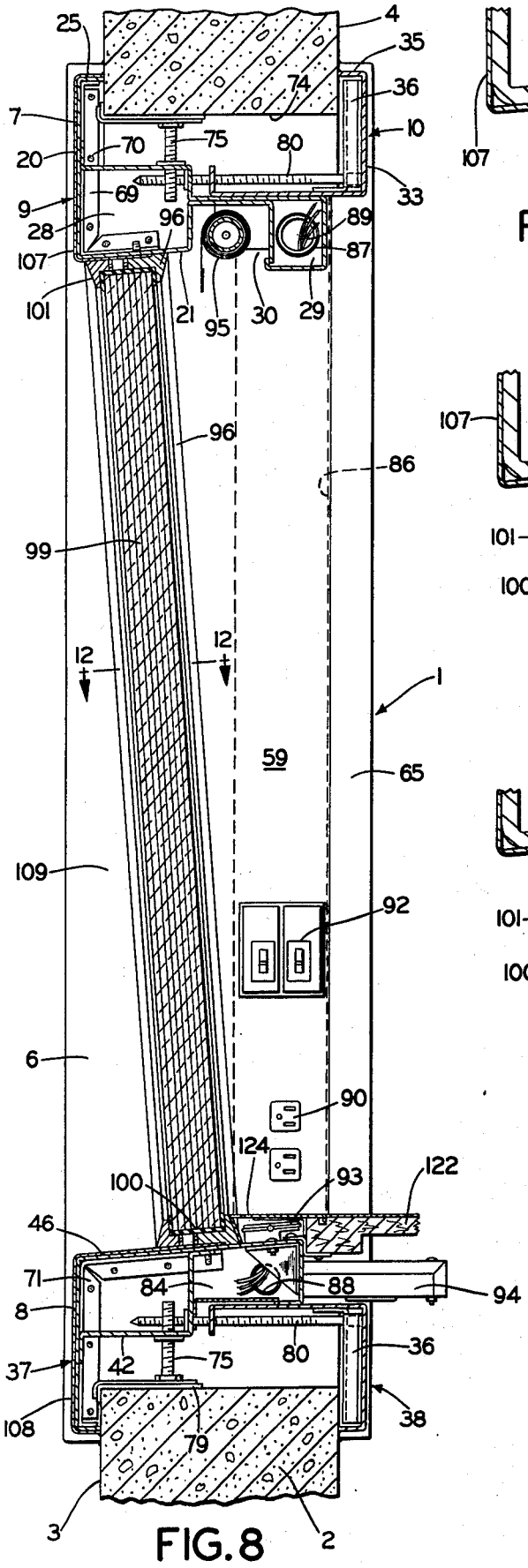
FIG. 8 is an enlarged sectional view taken on the line 8—8, FIG. 5 illustrating the adjustable mounting of the main window frame in a wall, and the mounting of the glass panel and glass frame in the main window frame.

As shown in FIGS. 7 and 13, the outer rectangular frame member portions 21 and 46 are angled slightly upwardly inwardly from the horizontal (FIG. 8 and 13) so that the glass to be mounted therein, as described below, will be slightly slanted out of vertical position, as shown in FIGS. 7 and 8.

During the assembly of the outer rectangular frame member, a sheet metal angle member 83 is assembled to engage portions 41 and 48 of the outer unit 37 of lower frame member 8 (FIG. 13) thereby forming a raceway 84 in the lower frame member. Similarly, an angular sheet metal closure member 85 is engaged with portions 59 and 63 of the vertical member outer unit 57 (FIG. 22) thereby forming a raceway 86 in each vertical frame member 6.

Openings 87 and 88 are formed in both vertical web jamb members 59 adjacent the upper and lower ends thereof (FIGS. 13 and 15). The openings 88 from communication between the raceway 84 in the bottom outer frame member unit 37 and the raceways 86 in the vertical outer frame member units 57. The openings 87 form communication between thee raceways 86 and the inner box channel 29 in the upper outer frame member unit 9.

The raceways 86, 84 and inner box channel 29 thus form a complete raceway channel extending entirely around the window frame and located adjacent the inner surface of the wall 2, thus providing a conduit wherein electrical cable wiring 89 may be located. The cable wiring 89 is prewired in the window frame to provide electric power for receptacles or outlets, such as shown at 90 and 91 in the window frame.

Control switches 92 (FIG. 8) also may be located at any desired place for various outlets or to control power supply to appliances. The window frame is prewired at the place where it is fabricated, and thus the necessity of wiring the window after installation in a building wall is avoided.

Appliances which may be installed adjacent the window may include a heater 93 cooperating with a blower 94 to defrost the window, as diagrammatically illustrated in FIG. 8.

A window shaft 95 of the usual roll type may be mounted in the rectangular recess 30 formed in the upper frame member (FIGS. 8 and 13).

Figure 9:
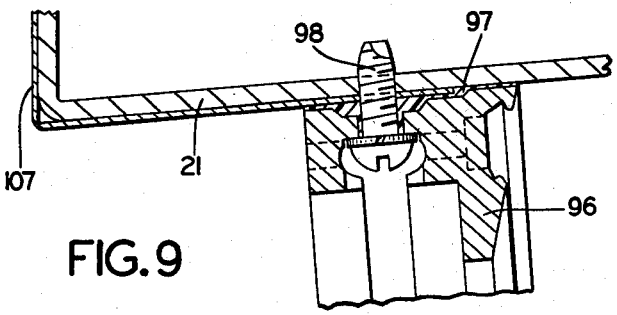
FIGS. 9, 10 and 11 are enlarged fragmentary sectional views of portions of the upper end of FIG. 8, illustrating steps in the assembly of the glass frame components and of a glass panel in the main window frame.
Figure 10:
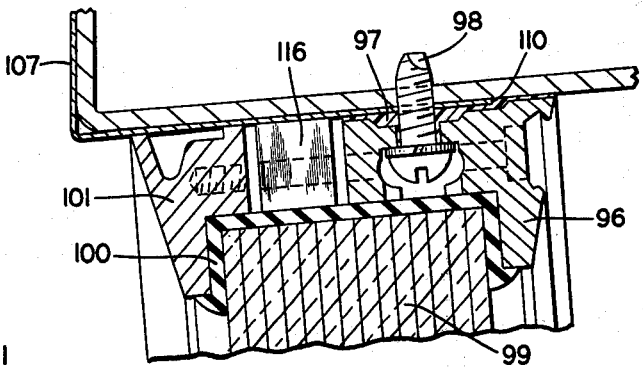
Figure 11:
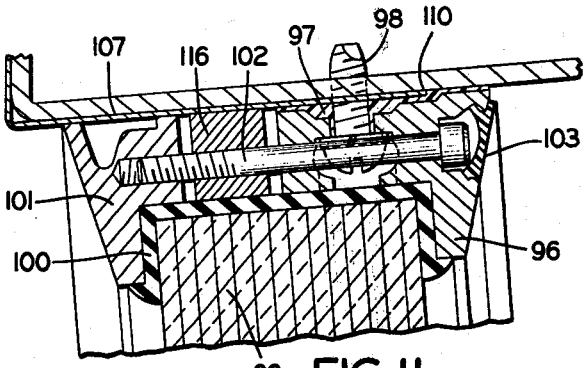
Figure 12:
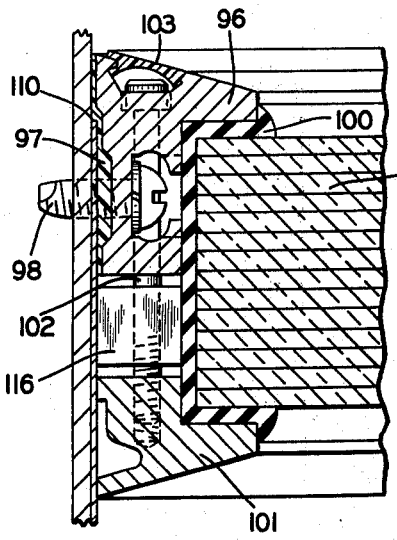
FIG. 12 is an enlarged fragmentary section looking in the direction of the arrows 12—12, FIG. 8.

The installation of the improved bank window 1, 1A or 1B involves two stages, the first being the installation of the window frame just described, and the second being the installation of the glass frame and glass is shown in FIGS. 9, 10 and 11.

The first stage of glass installation is illustrated in FIG. 9, wherein the inner glass frame 96 is mounted within the window frame. The frame 96 is composed of four members, all having the cross section shown in FIG. 9, there being a top member, two side members and a bottom member. These four members are mitred at their ends. A sealing mastic 97 is coated on the outer edge of inner frame members 96 and the frame members 96 are bolted at 98 to the web 21 of the outer frame member unit 9, to the horizontal flange 46 of the lower frame member unit 37 and to the member 59 to the vertical frame member unit 57.

A channel-shaped, preferably rubber, gasket 100 is engaged around the edges of a glass panel 99 of bullet-resisting glass; and the panel 99 then is seated from the exterior of the building in inner glass frame 96 (FIG. 10).

The rectangular outer glass frame 101 then is formed from four members all having the same cross section and having mitred joints at their ends. The four members comprise upper, lower and two side members, as shown in FIG. 5. The outer glass frame members 101 and are bolted to the inner glass frame members 96, as shown in FIG. 11 by bolts 102. The heads of bolts 102, which are located at intervals around the glass frame, are covered with an inner trim strip 103.

The manner in which the glass panel 99 and the inner and outer glass frames 96 and 101 are mounted in the window frame is a departure from prior art concepts. First, the glass is secured and clamped in the glass frame at the interior of the bank building. Thus, the glass cannot be removed from the outside of the building by normal attack measures directed against the glass frame.

Second, access to the bolts 102 on the inside of the building at the location of a teller station is easily achieved without major disturbance, for example, when it is necessary to replace the glass panel 99.

Third, when installing or replacing a glass panel 99, the glass panel is delivered to the exterior of the building and lifted to seat it in the inner glass frame 96 at the exterior of the building. Thus, the necessity of carrying a large heavy glass panel into a normal building entrance and through bank teller stations to the inside of the window is avoided. However, such measures have been necessary with prior art structures.

Figure 21:
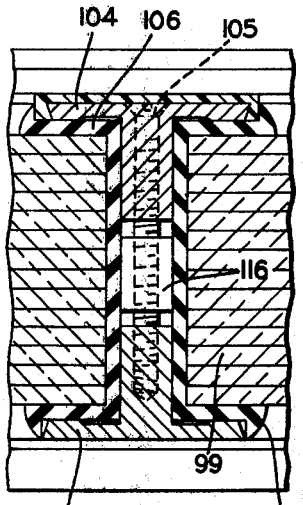
FIG. 21 is an enlarged sectional view taken on the line 21—21, FIG. 3 illustrating a joint between two adjacent glass panels.
Figure 23:
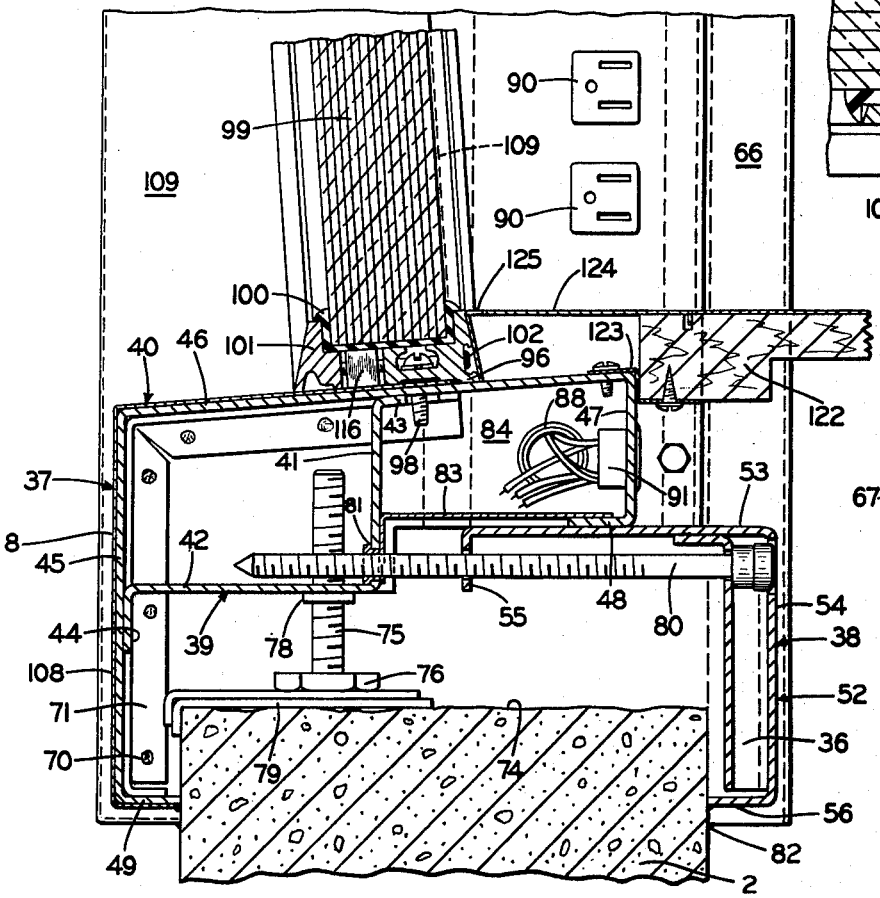
FIG. 23 is a fragmentary view looking in the direction of the arrows 23—23, FIG. 22.
Figure 23:
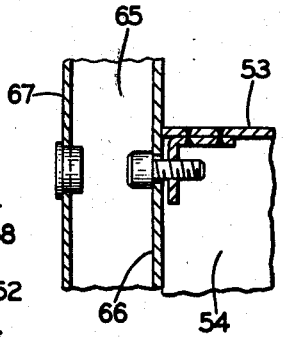

Fourth, and equally important, is the fact that the new construction is adapted to receive bullet-resisting glass panels of varying thicknesses depending upon the degree of thickness or security that is desired. Usual bullet-resisting glass thicknesses may range between 1 ⅛ and 1¾ in thickness.

Where the installation of wide windows is desired, such as the windows 1A and 1B of FIGS. 3 and 4, as previously stated, multiple standard sized glass panels 99 may be installed. It is only necessary under such circumstances to provide a vertical joint between adjacent glass panels 99, as indicated at FIG. 21, where inner and outer T-shaped members 104 are bolted together from the interior of the building by bolts 105. The T-shaped members 104 engage gaskets 106 provided at the adjacent edges of the two glass panels 99.

Another important aspect of the invention, relating to the modular construction, involves the provisions for installing cladding or trim material on the exterior surfaces of the window frame to satisfy architectural design requirements. In other words, for architectural purposes, the window frame may be required to have a bronze, or an aluminum, or a stainless steel exterior surface; or it may be desired that the window frame shall present an exterior weather-proof colored surface. Heretofore, it has been necessary, in order to satisfy such architectural requirements, to form the entire main window frame members, etc. of the specified material such as bronze, aluminum, or the like.

The improved construction of the invention eliminates this requirement and permits thin sheets of cladding material to be applied to the exterior surfaces of the window frame, as indicated by the channel-shaped cladding 107 applied to the upper window frame member 7 (FIGS. 9, 10, 11 and 13). FIGS. 8 and 13 also illustrate the thin sheet material channel-shaped cladding member 108 applied to the lower window frame member 8. Similarly, FIG. 22 illustrates the channel-shaaped thin material cladding member 109 applied to the main vertical window side frame members 6.

The cladding material edges along the outer terminal flanges of the outer window frame member components are also sealed against the outer surface of the building wall 2 by the caulking material 82 previously described (see FIGS. 13 and 22).

As shown in FIGS. 9 to 13 and 22, the raw edges 110 of the cladding material at the inner edges of channel-shaped trim members 107, 108 and 109 are located between the main window frame members and the inner glass frame members 96 which are bolted to the window frame members by bolts 98.

Thus, as well shown in FIG. 9, the zone of the cladding material adjacent the raw edge 110 is secured to the window frame members by the bolts 98. Also, the raw edge 110 is covered and sealed by the mastic sealant material 97, present between the glass and window frame members. Also, when the channel-shaped cladding material trim members 107, 108 and 109 are assembled to envelope the outer surfaces of the primary window frame members, a usual adhesive material may be applied at the contiguous surfaces.

Another aspect of the invention relates to the manner in which the cladding trim material 107–108–109 is applied to the exterior surfaces of the primary upper, lower and vertical outer window frame members at the four corners of the outer window frame to achieve a waterproof structural arrangement at the corners. This feature is shown in FIGS. 16, 27 and 28.

Figure 29:
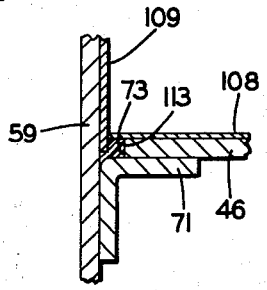
FIG. 29 is a fragmentary section taken on the line 29—29, FIG. 28.

The notches 68 in the horizontal flange 46 of the lower outer frame member unit 40 have been described in connection with FIGS. 15 and 16. These notches 68 form recesses 73 when the outer frame members are assembled together to form a corner. The lower left-hand corner of the window 1 is illustrated in FIG. 16 after such assembly of the primary outer frame members. When cladding trim is applied to the window frame, the first step is to assemble one of the channel-shaped side cladding members 109 over the exterior surfaces of the primary outer unit 57. As member 109 is assembled, as shown in FIG. 27, edges 111 and 112 of the cladding material 109 extend into the recess 73 which previously is filled with mastic sealant material 113 (FIG. 29).

Next, a channel-shaped cladding material member 108 is applied to the member 40. During this step the end edges 114 and 115 of member 108 engage outer surface portions of the previously applied cladding material 109 (FIG. 28). The sealing material trapped in the recesses 73 at each of the lower corners of the window frame provide a waterproof joint, not only between the cladding material members 108 and 109, but also between the various primary outer frame members assembled together to form a corner joint, one of which is illustrated in FIG. 16.

The upper channel-shaped cladding material trim member 107 is assembled to the upper primary frame member in the same manner as described for the trim member 108. The corner joints, and all four corners of the outer rectangular frame member, are sealed by the sealant 113 filling the recesses 68 at each corner.

The mounting of a glass panel 99 in the glass frame, and the assembly of the glass frame members 96 and 101 with the bolts 102 has been described in connection with FIGS. 9 to 12. It is preferable to insert a spacer block 116 between the inner and outer glass frame members 96 and 101 to assist in supporting the weight of the glass.

Another important aspect of the modular construction of the improved bank window is the ability to use the same basic members, identical in most cases except for lengths, in fabricating window frames of various sizes and for various thicknesses of building walls, and various thicknesses of glass panels.

Figure 24:
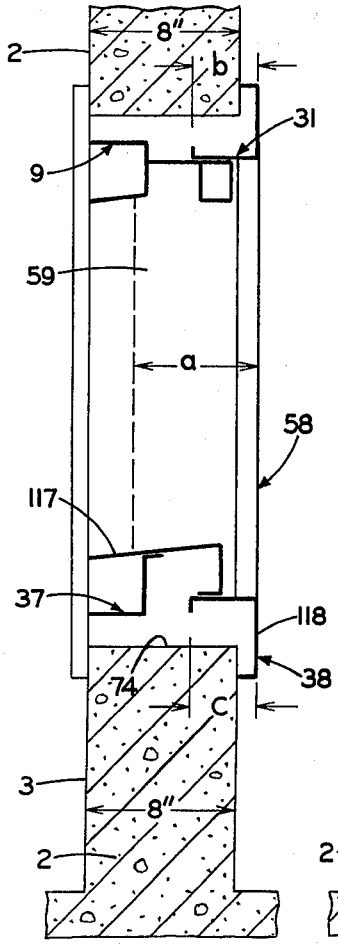
FIG. 24 is a diagrammatic view illustrating the window installed in bank building wall.
Figure 25:
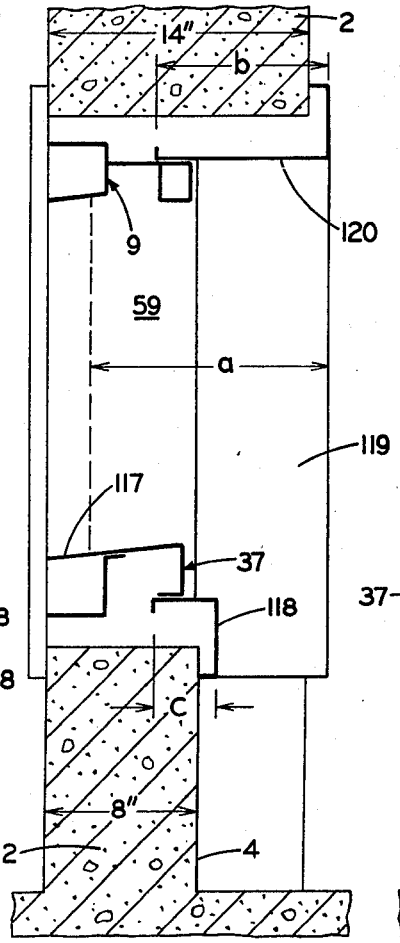
FIG. 25 is a view similar to FIG. 24 showing the window installed in a thicker bank building wall.
Figure 26:
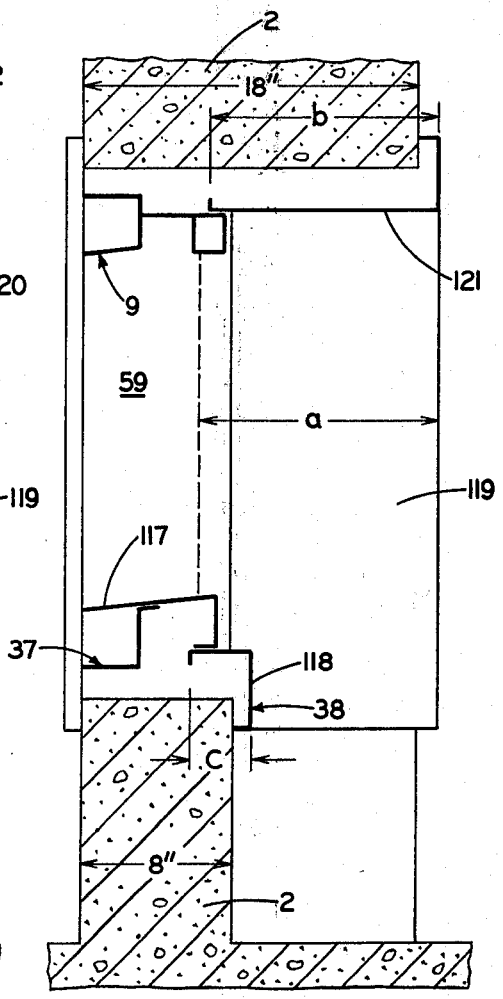
FIG. 26 is a view similar to FIGS. 24 and 25, showing the window installed in a still thicker wall.

Diagrammatic illustrations of windows installed in building walls of three different thicknesses are presented in FIGS. 24, 25 and 26. The window in FIG. 24 is illustrated as installed in an 8 inch wall. The window in FIG. 25 similarly is installed in a 14 inch wall, except that below the window, the wall is only 8 inches thick so as to provide room for the teller and teller's equipment located just inside the window. The window in FIG. 26 is illustrated as installed in an 18 inch wall with an 8 inch wall below the window. The outer window frames only, without the glass and glass frames, are illustrated diagrammatically with single lines at 117.

The outer frames 117 are the same for all windows regardless of wall thickness. The lower member 118 of the inner frame unit 38 is the same in all three windows of FIGS. 25 to 26 for the 8 inch wall thickness below the window.

The inner side frame members 119 of the windows in FIGS. 25 and 26 are the same but have a larger flange width (dimension *a*) than that of the similar member 58 in FIG. 24 so that side members 119 can telescope over the corresponding side frame members in the outer frame. Two different top frame members 120 and 121 with different flange widths *b* are used, respectively, in the windows of FIGS. 25 and 26. The dimensions in FIGS. 25 and 26 each are greater than dimension *b* of member 31 in FIG. 24.

The flange width of the members 118 may be greater if the wall beneath the window has a substantially greater thickness than 8 inches.

Thus, the only changes in the window constructions to accommodate different wall thicknesses are in the dimensions *a*, *b* and *c* of the respective components of the rear frame members and in the length of the bolts used to clamp the inner and outer frames together. Also, as previously indicated, a change in the glass size of the glass panels as to height or length only involves a change in the lengths of the various components of the window and glass frames involved.

In this manner, various sized windows for various thickness building walls, and various sized glass frames or various sized glass panels, may be manufactured as standard components and cut to the desired lengths to accommodate any window size selected.

A usual counter used by a teller is indicated at 122 in FIGS. 2, 6, 7, 8, 13 and 22, and the counter may be assembled inside of the bank window 1 supported at 123 (FIG. 13) by brackets on the lower frame member 8. A grill member 124 (FIGS. 13 and 22) with grill openings 125 may extend from counter 122 to the lower inner glass frame member to direct the discharge of air blown by the defroster blower 94 across the heater 93 (FIG. 8) and through the defroster grill openings 125.

The screw jacks or leveling bolts 75, as described, enable the entire window frame installation to be leveled and spaced the proper distance above the floor inside the bank building so that the teller's counter 122 is located at the desired height or level. Similarly, the clamping bolts 80 used to secure the inner and outer frame members of the window frame together, when tightened, pull the head, jamb and sill members of the outer or front and inner or back window frames into gripping engagement with the building wall.

Accordingly, the new bank window construction combines new concepts, including the modular main window frame and glass frame constructions using the same vertical components and the same formed sections for horizontal components to accommodate various window widths for one or a plurality of standard sized glass panels; including the ability of the modular construction to provide window installations for various wall and glass thicknesses; including provisions for satisfying architectural appearance or design requirements by cladding the exterior surfaces of the window frame with thin cladding or trim sheet material of the desired metal, material or color; including provisions for forming weather-sealed joints at exterior and clad material window frame corners, and the further provisions of covering the raw edges of the cladding or trim material with glass frame members; including the provision of adjustable means for leveling and locating the window frame at the desired level in the wall opening; including a construction in which glass panels may be replaced from the exterior or outside of the building by using a split glass frame and glass frame clamping means located inside the building; including the formation of a raceway surrounding the interior of the window frame in which electrical cable means are prewired in the raceway at the fabrication plant for supplying power to convenience outlets, electrical switches, defrosters, etc., mounted in or adjacent the frame; including provisions for mounting a window shade within the window; and including the ability to install various kinds of teller deal drawer mechanisms beneath the window and accessible to a teller at a teller counter inside the window.

Accordingly, the improved construction provides for the manufacture and installation of bank window frames which eliminate previous limitations of custom design and construction for each individual installation, and which provides a construction which achieves the objectives stated, eliminates the difficulties heretofore existing in the art, and solves problems and obtains the new results indicated.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features and principles of the invention, the manner in which the new bank window construction is designed, built, installed, repaired, and the advantageous, new and useful results obtained; the new and useful structures, devices, components, elements, arrangements, parts, combinations and relationships are set forth in the appended claims.

I claim:

1. In bullet-resisting glass bank window construction adapted to be mounted in a building wall opening, the combination of front and back window frames each having head, jamb and sill members forming a rectangular frame; each head, jamb and sill member having a terminal flange and engaging flange means spaced inwardly from the terminal flange in the rectangular frame; said front window frame head, jamb and sill member engaging flange means including frame front flanges extending from said terminal flanges, and frame web members extending from said front flanges to zones within the back window frame; said front window frame engaging flange means also including telescoping flanges spaced from said web members and located in said zones and offset laterally outward of the frame from the web members; said back window frame head, jamb and sill member engaging flange means including telescoping flanges extending toward and adjustably telescoped over the front window frame telescoping flanges; bolt means accessible at the back frame engaged with the front and back frames, operative to clamp the terminal flanges on the front and back frames against exterior and interior building wall surfaces with the telescoped engaging flange means telescoping flanges extending through a window frame opening in a building wall; separable rectangular inner and outer glass frame means; means mounting the inner glass frame means within the front window frame engaging flange means web members; bullet-resisting glass panel means mounted between the inner and outer glass frame means bounded by said web members; and bolt means accessible interiorly of the window frame clamping the outer glass frame means against the glass panel means and to the inner glass frame means.

2. The construction defined in claim 1 in which the front window frame head, jamb and sill member engaging flange means includes walls forming raceways in said flange means entirely surrounding the front window frame.

3. The construction defined in claim 1 in which the front window frame head, jamb and sill member terminal flanges, front flanges and web members are covered with thin sheet cladding material.

4. The construction defined in claim 3 in which raw edges of the cladding material are clamped between the glass frame means and the front window frame web members.

5. The construction defined in claim 3 in which sealed joints are formed at the corners of the front window frame between head, jamb and sill portions of the cladding material and between the cladding material and front frame head, jamb and sill member front flanges and web members.

6. The construction defined in claim 1 in which the glass panel means comprise one or a plurality of glass panels and in which the same jamb members are assembled to form the front and back window frames, regardless of the number of glass panels mounted in the window frame.

7. The construction defined in claim 6 in which the head and sill members forming the front and back window frames each have the same cross-sectional contour regardless of the number of glass panels mounted in the window frame.

8. The construction defined in claim 5 in which recesses are formed around the corners between the front frame head, jamb and sill members; and in which the cladding material on the jamb members extends into said recesses.

9. The construction defined in claim 8 in which sealant material is provided in said recesses to form the sealed corner joints.

10. The construction defined in claim 1 in which the back frame head, jamb and sill members are formed as angular members in cross section having said telescoping flanges extending into the building wall opening; and in which said telescoping flanges of the back frame engaging flange means having predetermined widths depending upon and adapted to accommodate building walls of various thicknesses.

* * * * *